US007264740B2

(12) United States Patent
Horne

(10) Patent No.: US 7,264,740 B2
(45) Date of Patent: Sep. 4, 2007

(54) PROCESS FOR INCREASING STRENGTH, FLEXIBILITY AND FATIGUE LIFE OF METALS

(76) Inventor: David Hughes Horne, 2229 Laird Way, Salt Lake City, UT (US) 84108-1924

( * ) Notice: Subject to any disclaimer, the term of this patent is extended or adjusted under 35 U.S.C. 154(b) by 93 days.

(21) Appl. No.: 10/809,989

(22) Filed: Mar. 26, 2004

(65) Prior Publication Data

US 2005/0082259 A1 Apr. 21, 2005

Related U.S. Application Data

(60) Provisional application No. 60/458,270, filed on Mar. 28, 2003.

(51) Int. Cl.
*C23F 1/00* (2006.01)

(52) U.S. Cl. ..... 216/32; 216/56; 216/83; 216/100; 216/102; 427/307

(58) Field of Classification Search ..... None
See application file for complete search history.

(56) References Cited

U.S. PATENT DOCUMENTS

| | | | | | |
|---|---|---|---|---|---|
| 2,517,430 | A | * | 8/1950 | Hensel et al. | 427/272 |
| 4,157,991 | A | * | 6/1979 | Pilla | 524/46 |
| 4,298,635 | A | * | 11/1981 | Lovell | 427/247 |
| 5,089,227 | A | * | 2/1992 | Thompson et al. | 422/16 |
| 5,462,892 | A | * | 10/1995 | Gabriel | 438/656 |
| 5,854,134 | A | * | 12/1998 | Lan et al. | 438/695 |
| 6,035,681 | A | * | 3/2000 | Chung et al. | 72/42 |
| 2002/0077004 | A1 | * | 6/2002 | Lawrence | 439/887 |

FOREIGN PATENT DOCUMENTS

| | | | | |
|---|---|---|---|---|
| DE | 2447208 | A | * | 4/1976 |
| EP | 976795 | A2 | * | 2/2000 |
| GB | 1416709 | A | * | 12/1975 |
| JP | 58224178 | A | * | 12/1983 |
| JP | 60002681 | A | * | 1/1985 |
| JP | 01268650 | A | * | 10/1989 |
| JP | 05211146 | A | * | 8/1993 |
| JP | 07316899 | A | * | 12/1995 |
| JP | 08276533 | A | * | 10/1996 |
| JP | 10276055 | A | * | 10/1998 |
| JP | 2000338685 | A | * | 12/2000 |
| JP | 2002099101 | A | * | 4/2002 |

OTHER PUBLICATIONS

"Currents" Winter 2003, pp. 80-86.*
Super CORR-B MSDS, Jan. 6, 2003.*
1006 Contac MSDS, May 18, 2001.*
STN search of CAS registry numbers with chemical composition, Jun. 13, 2007.*

* cited by examiner

*Primary Examiner*—Anita Alanko
(74) *Attorney, Agent, or Firm*—Jones, Waldo, Holbrook & McDonough; K. S. Cornaby

(57) ABSTRACT

A method is described for the surface treatment of metals to improve the strength, flexibility and fatigue life of the metal, which in a preferred embodiment includes the steps of thoroughly cleaning and drying the metal surface, etching the surface of the metal to remove sharp apexes and ends of cracks in the metal surface, water rinsing and drying the metal surface, and coating the surface with a low water miscible, water displacing, low surface tension corrosion preventive compound.

1 Claim, No Drawings

PROCESS FOR INCREASING STRENGTH, FLEXIBILITY AND FATIGUE LIFE OF METALS

CROSS-REFERENCE TO RELATED APPLICATION

This application claims priority of the filing date of Provisional Application Ser. No. 60/458,270 filed 28 Mar. 2003, the entire contents of which are incorporated herein by reference.

RIGHTS OF THE GOVERNMENT

All rights to the invention described herein have been waived by the United States Air Force for the Government of the United States and authorization has been given to the inventor to pursue a letters patent on his own. A copy of the Government recognition that the full rights to the invention belong to the inventor is attached.

BACKGROUND OF THE INVENTION

The present invention relates generally to surface treatment methods for metals and alloys, and more particularly to a method for surface treating metals to increase strength, flexibility and/or fatigue life of the metals.

Being able to reduce the quantity and mass of metals for a particular strength requirement not only could reduce the demand for strategic materials but also reduce the weight of all manner of products, for example, reduce the weight of land, sea, air and space vehicles that demand great quantities of fuels to propel them. Making metals less susceptible to failure in bending will provide additional flexibility when needed. Metals subjected to cyclic bending, compression, shear, or tension loads universally are known by metals technicians to eventually fail catastrophically without significant warning. The failure process is called fatigue. Fatigue in all manner of metal uses such as in springs; aircraft structures; bridges; railroad rails; engine connecting rods, crankshafts, and timing chains; gun barrels; elevator cables; automobile, truck, and railroad car chassis; flag poles; vehicle axles, wheels, and transmission gears may require the metal to be replaced in a predictable time or by careful periodic examination of the metal to determine if cracks are occurring. Metal fatigue has been recognized to occur more rapidly in corrosive environments than in benign environments, such failure referred to as corrosion fatigue, wherein the presence of air contributes substantially to fatigue crack propagation (see, e.g., Douquette, *"A Review of Aqueous Corrosion Fatigue"*, in Corrosion Fatigue-Chemistry, Mechanics, and Microstructure (The National Association of Corrosion Engineers, 1972). Douquette wrote, "The majority of observed fatigue failures are, in fact, corrosion fatigue failures, since only fatigue occurring in an absolute vacuum could be termed as pure 'fatigue.' For example, it has been shown that for many metals, air contributes quite strongly to increases in fatigue crack propagation." Corrosion fatigue in aqueous solutions generally may be accepted as the result of an electrochemical process, but Douquette continues, ". . . no mechanism has been proposed to fully explain observed decrease in fatigue life of metals in corrosive environments."

Moisture's presence also is a factor in the tensile strength and fatigue life of metals. A metal stressed in tension can be affected by chemicals and moisture that can act as either a catalyst or actually enter into the corrosion fatigue reaction.

The stress intensity factor at crack tips (apexes) and ends increases the metal to metal bond stretching or compression stresses within the metal, and bond stretching or compression increases the energy inherent in the bonds. This bond to bond energy is readily recognized in springs that do work to relieve both compression and tension deformations. That deformation energy can provide additional enthalpy as activation energy to initiate a corrosive chemical reaction at the crack tips or ends that could result in crack growth or extension. The same phenomenon exists with scratches, gouges, pits, rough surfaces, and other surface imperfections especially at small radii. The greater the stress intensity factor and bond deformation the greater the bonds' oxidation probability. Surface imperfections are where moisture, chemicals, oxygen, and other substances can react to cause crack growth. However, as crack tips penetrate deeper the metal's cross-sectional area strength decreases and exacerbates the stress intensity factor at all imperfections in the vicinity where a crack extension has occurred. By removing an aggressive environment in the metal cracks, a corrosive chemical reaction may be mitigated or prevented. If not mitigated at crack tips, the cracks continually may propagate deeper into the metal increasing catastrophic part failure probability in either a tension or fatigue potential load.

In accordance with a governing principle of the invention described herein, it is first noted that some surface cracks in metals may be attributed to thermal contraction at the surface inherently in contact with the interior mass, which is constantly at a higher temperature than the surface during cooling. Continued contraction of the interior material may result in redistribution of stress toward the surface with resultant surface cracking. When the surface is thoroughly solidified, the interior mass still may be cooling, and as the interior of the mass finally thermally contracts in tension at equilibrium temperature, the slightly subsurface mass in compression may act as a fulcrum to put the surface in tension causing cracks. Prevention of large stress intensity factors and corrosion at crack tips may prevent loss of inherent metal strength and corrosion fatigue. These benefits therefore are accomplished by preventing corrosion at the apexes of surface imperfections.

The invention described herein solves or substantially reduces in critical importance problems with prior art techniques by providing a method for surface treating metals by which the strength, flexibility and fatigue life of the metal is increased by preventing corrosion in surface cracks in the metal. According to a preferred embodiment of the invention, the metal surface is water cleaned and dried, etched to remove sharp apexes of the cracks in the metal surface, rinsed, dried and coated with a water displacing low surface tension corrosion preventive compound.

It is a principal object of the invention to provide a method for surface treating metals.

It is another object of the invention to provide a method for improving the corrosion resistance of metals.

It is a further object of the invention to provide a method for improving the strength of metals by novel surface treatment.

It is a further object of the invention to provide a method for improving the flexibility of metals by novel surface treatment.

It is a further object of the invention to provide a method for improving the fatigue life of metals by novel surface treatment.

These and other objects of the invention will become apparent as a detailed description of representative embodiments proceeds.

SUMMARY OF THE INVENTION

In accordance with the foregoing principles and objects of the invention, a method is described for the surface treatment of metals to improve the strength, flexibility and fatigue life of the metal, which in a preferred embodiment includes the steps of cleaning the surface thoroughly by water, aqueous detergent and rinse, brushing, or solvent cleaning and drying the metal surface; applying an etch to the surface of the metal to increase the radii of sharp crack or imperfection tips in the metal surface; water rinsing and drying the metal surface; and coating the surface with a water displacing low surface tension corrosion preventive compound.

DETAILED DESCRIPTION

In accordance with preferred embodiments of the invention, the method of the invention first comprises thorough cleaning of the new metal surface to remove mill scale, soils, oils, and corrosion products; also for used metals to remove corrosion products, galvanizing, primers, paint, or other coatings that may remain after the processing steps in formation and use of the metal part. The surface cleaning for each respective metal may be accomplished by conventional processes as would occur to the skilled artisan practicing the invention in accordance with customary shop, American Society of Metals (ASM), or American Institute of Metallurgical Engineers (AIME) recommendations. Representative cleaning materials may include sand blasting; water (including pressurized water); pressurized air; or conventional hydrocarbon solvents such as isopropyl alcohol, other alcohols, ketones, aliphatic hydrocarbons, naptha, or certain ring compounds, or water base cleaners containing such as citrus agents, detergents, and alkali soap solutions; or other conventional cleaning solutions selected consistent with the metal surface to be cleaned, the specific cleaning material not considered limiting of the invention. The metal then optionally may be conditioned by heating to a low temperature along with an air blast to remove any remaining materials used to clean and then dry the surface. Heating of the metal need be only sufficient (time and temperature) (such as in the range of 150° to 250° F.) to remove residual water and solvents but insufficient to anneal or otherwise cause metallurgical changes in the metal. A blow dryer may be okay in some cases.

After thorough cleaning and drying then a etch is applied to the cleaned metal surface to reduce stress concentration points at the sharp edges and tips in any surface cracks in the metal as discussed above. For metals that are particularly hydrogen embrittlement sensitive a low hydrogen-embrittling etch are preferred. Etching should be applied with technical care, and removed when the proper etch time has elapsed. Due to the large number of different metals and alloys and the wide variety of etches available the specific etch material is not considered limiting of the invention. In order for the etch to penetrate most effectively to tips or ends of cracks or imperfection an etch solution that contains an etch that can be emitted as a vapor or gas from the solution such as hydrofluoric acid that emits hydrogen fluoride, HF; hydrochloric acid that emits hydrogen chloride, HCl; or for amphoteric metals, either these acids or ammonium hydroxide that emits ammonia, $NH_3$, may be used and are preferred, these also are not considered limiting of the invention. It is recommended that whatever etch is considered should be tested on metal coupons with similar surface characteristics as the parts to be treated to determine the effectiveness to round out the crack tips to reduce or eliminate the stress intensity factor; a scanning electron microscope may reveal the nature of crack tips before and after etching this also is not considered limiting of the invention. The etch solution may be selected according to the specific metal being treated (as by reference to standard texts such as Guenter Petzow, Metallographic Etching, $2^{nd}$ Edition, ASM International (1999), or the ASM Metals Handbook). The following Table I lists some recommended etchants for selected metals, but these formulas listed in these publications are intended for etching small samples for short times as listed in Petzow and may require concentration adjustment and/or temperature control for large areas to achieve optimum but prevent excess etching.

The etchant is then removed from the metal surface and the surface is rinsed with clean (preferably purified, deionized) water. The surface is dried thoroughly (preferably including using pressurized air to help remove any remaining moisture containing etch in the surface).

TABLE I

| Metal Selection | Recommended Etchant(s) |
|---|---|
| Aluminum and its alloys | 5 to 20-g NaOH in 100-ml distilled water |
| Aluminum Foundry Alloys | 75 ml. 32% Hydrochloric acid (HCl), 25 ml. 65% Nitric acid, 5 ml. 40% Hydrofluoric acid (HF) |
| Beryllium technical grade | 90 ml distilled water, 10 ml. 32% HCl, 4 g ammonium chloride |
| Cobalt-Chrome Alloys | 50 ml. Distilled water, 50-ml 32% HCl |
| Copper and Brasses | 120 ml. Distilled water or 96% ethanol, 30 ml. 32% HCl, 10 g iron (III) chloride |
| Unalloyed & Alloy Steels | 500 ml. Distilled water, 500-ml. 96% Ethanol, 30 g iron (III) chloride, 1 g copper (II) chloride, 0.5 g tin (II) chloride, add last 42 ml. 32% HCl, |
| Austenitic and heat resistant steels | 50 ml. 32% HCl, 25 ml. Saturated aqueous copper (II) sulfate solution |
| Magnesium | 100 ml. Distilled water, 10 ml. Glacial acetic acid |
| Titanium | 90 ml distilled water, 10 ml. 40% HF |
| Tungsten | 75 ml. Distilled water, 35 ml. 65% Nitric acid, 15 ml. 40% HF |
| Zirconium & Hafnium | 70 ml. Distilled water, 30 ml. 65% Nitric acid, 10 ml. 40% HF |
| Zinc | 95 ml. 96% Ethanol, 5 ml. 32% HCl |

In accordance with a principal feature of the method of the invention, to the cleaned and dried metallic surface is then applied (as by rolling, spraying, or brushing) a thin (less than 1 mil is adequate) surface coating of a water displacing, corrosion preventive compound (CPC) with a low surface tension (preferably less than 30-dynes/cm), a wide liquid temperature range to assure a perpetual liquid state, a low vapor pressure to prevent evaporation from the treated surface to at least 300° F., and very low water miscibility. Table II lists some recommended CPCs for most metals.

TABLE II

| Metal Service | Recommended CPC(s) |
|---|---|
| All structural metals including all metals listed in Table I | SUPER CORR-A or B; Lektrotech, Inc, 4302 Henderson Boulevard Suite 114, Tampa, Florida 33629, P.O. Box 18566 Zip 33679, (813) 254-1380; or 1006 Con-Tac; International Lubricants and Fuel Consultants (ILFC), 521 Quantum Road, Rio Rancho, New Mexico, 87124, (505) 892-1666; Both of these CPCs conform to MIL-L-87177A Grade B and have been tested in lab and field tests with excellent corrosion preventive results. |

The composition of SUPER CORR-B is 80-98 weight percent 1,1-dichloro-1-fluoroethane, 1-5 weight percent oxygenated hydrocarbon, and 1-5 weight percent carbon dioxide propellant. The composition of 1006 CONTAC is less than 10 weight percent barium dinonylnaphthalene-sulfonate, a homopolymer of 1-decene, 2-butoxy-1-ethanol. and ethyl acetate.

The two preferred products presented in Table II used in the testing are known to be excellent corrosion preventive compounds. They conform to MIL-L-87177A, and any CPC to be considered for use that conforms to MIL-L-87177A (or later revision), Grade B probably will provide the corrosion resistance to achieve optimum results from the invention but are not considered limiting of the invention. Rolling a cylindrical rubber roller over the surface while spraying CPC on the metal to force the CPC into the cracks should help press the CPC into cracks and extrude the water in the low spots and cracks, but use of a roller is not considered limiting of the invention. Since the CPC is not miscible with water and has a much lower surface tension than water, once it is in the cracks, evaporation of the carrier solvent will assist expulsion of any moisture and provide a substantially increased corrosion protective coating for the metal. Preventing or mitigate corrosion at the tips of cracks and imperfections may help to increase strength, flexibility, and fatigue life. Optionally the parts may be heated even above the boiling temperature of water at ambient pressure to evaporate any fugitive moisture in the cracks, holes, or imperfections in the surface. Whatever CPC is chosen care must be exercised to not exceed the annealing temperature of the metal, however the recommended CPCs remain liquid at Standard Atmospheric Pressure, 14.7-psi, to about 550° F., so elevating the temperature even to 250° F. will not degrade the CPC. Thereafter water or humidity exposure should not remove a low surface tension, water immiscible CPC, and the CPC may obscure humidity or water from the metal and may mitigate or prevent further corrosion at cracks, holes, and imperfection tips.

For a metallic part or parts of size that can be accommodated by an available vacuum chamber or vacuum bag, the optional step of treating parts that have been etched, rinsed and coated with a CPC may be performed wherein the part in the vacuum chamber or vacuum bag at less than atmospheric pressure may more nearly quantitatively remove moisture entrained under the CPC in the cracks. In the event a vacuum autoclave is available an additional optional step of heating the parts to an elevated temperature above the boiling point of water at the reduced absolute pressure may quantitatively remove moisture in the cracks, holes and any surface imperfections. The saturated vapor line, the boiling point of water at different absolute pressures can be determined from the published "Steam Tables" (see Ellenwood et al, Thermodynamic Charts, John Wiley & Sons (1944), especially Tables 5B, 6A, or 6B). Table III presents water's boiling temperature at reduced, absolute, pressures from the Thermodynamic Charts. Reducing the pressure in the autoclave or vacuum chamber to 10-psia and elevating the temperature to 200 ° F may remove any remaining water within the surface cracks. When atmospheric pressure is restored to the surface of the metal the CPC may be driven further into the surface cracks or cavities, thus may provide a long term corrosion preventive treatment that may mitigate or prevent deeper crack penetrations, provide premium corrosion protection on the metal and at crack apexes. These treatments may result in increased metal strength, increased flexibility, and significantly increased fatigue life, all desirable phenomena.

TABLE III

Boiling Points of Water at Various Absolute Pressures

| | Absolute Pressure, psi | | | | | | | | | |
|---|---|---|---|---|---|---|---|---|---|---|
| | 14.7 | 13 | 12 | 11 | 10 | 9 | 8 | 7 | 6 | 5 |
| Boiling Point, ° F. | 212 | 205 | 202 | 198 | 195 | 190 | 185 | 180 | 170 | 162 |

A coating over the treated metal to protect the CPC from being compromised is recommended particularly if the metal surface is reasonably expected to be used in or stored in outdoor environments to screen ultraviolet, or could be removed by cleaning agents or solvents in indoor use, but application of a coating or the particular coating used is not considered limiting of the invention.

If electroplating metal over the imbedded CPC is anticipated, the CPC is not expected to cause much greater resistance to electroplating forces although the CPC may have a high dielectric constant (as is typical with low water miscible organic), because it has such a low surface tension. To increase the attraction of the ions from the plating bath through the CPC from a slightly greater distance across the CPC coating than normal plating operations, a small voltage increase may be required. However the ions are expected to penetrate the low surface tension CPC and attach to the metal as well as with a water solution contacting the metal directly. The metal ions will pass through the CPC to plate on the base metal and the electrical current will pass back to the plating solution. No greater force may be required for the ions and electrons to pass through the water/CPC interface.

Oil base primers miscible with the CPC may be applied directly over the treated surface. Epoxy primers may require additional surface force application with gun or brush force to bite onto the metal, but epoxies may allow the CPC to pass into its interstices and provide a greater corrosion resistance than with just the epoxy primer. A polyurethane topcoat or another material with zinc oxide or other ultraviolet light blocking ability may be used if the treated metal will have sunlight or other UV exposure. When a coating such as a water base primer is used over the etched and CPC protected metal, an initial coating that has a binder soluble or miscible in the hydrocarbon CPC such as Eastman Chlorinated Polyolefin PM06357-00 or PM 06362-00 from the Eastman Chemical Company, Kingsport Tenn., should make attachment to the metal possible with adhesion as good as when coatings are applied over moisture from humidity.

In one demonstration of the invention, fatigue testing of twenty-five dog bone coupons of 2024-T3 aluminum as a model for metals at 40-Ksi after 336-hours of cabinet salt spray resulted in the untreated coupons failing between 20,000-cycles and 27,000-cycles, however the twenty treated coupons all endured a minimum of 100,000-cycles, seven endured more than a million-cycles, and four ran out, were removed from the test, between three-million and four million cycles.

The invention therefore provides a method for surface treating metals to increase strength, flexibility and fatigue life of the metals. It is understood that modifications to the invention may be made as might occur to one with skill in the field of the invention within the scope of the appended claims. All embodiments contemplated hereunder that achieve the objects of the invention have therefore not been shown in complete detail. Other embodiments may be developed without departing from the spirit of the invention or from the scope of the appended claims.

I claim:

1. A metal surface treatment to increase strength, flexibility and fatigue life of a metal, and to protect metal-to-metal bonds at the apexes of cracks, scratches and gouges on the surface of the metal, comprising the steps in the following order of:

(a) cleaning the surface of the metal to remove mill scale, soils, oils, corrosion products and previous coatings;

(b) removing moisture from said apexes;

(c) applying a metal etch to the surface of the metal;

(d) rinsing and drying said metal surface; and (e) applying a liquid corrosion preventative compound to said etched surface, whereby the strength, flexibility, and fatigue life of the metal are increased relative to a metal surface that has not been treated with steps (a) through (e), wherein said liqiuid corrosion preventative compound has a surface tension of less than 30 dynes/cm and has a composition that comprises either (i) 80-98 weight percent 1,1-dichloro-1-fluoroethane, 1-5 weight percent oxygenated hydrocarbon, and 1-5 weight percent carbon dioxide propellant, or (ii) less than 10 weight percent barium dinonylnaphthalenesulfonate, a homopolymer of 1-decene, 2-butoxy-1-ethanol, and ethyl acetate.

* * * * *